US009711034B2

(12) United States Patent
Daniel

(10) Patent No.: US 9,711,034 B2
(45) Date of Patent: Jul. 18, 2017

(54) SECURITY SYSTEM AND METHOD

(76) Inventor: Isaac S. Daniel, Miramar, FL (US)

( * ) Notice: Subject to any disclaimer, the term of this patent is extended or adjusted under 35 U.S.C. 154(b) by 263 days.

(21) Appl. No.: 13/029,292

(22) Filed: Feb. 17, 2011

(65) Prior Publication Data

US 2011/0215932 A1 Sep. 8, 2011

Related U.S. Application Data

(63) Continuation-in-part of application No. 12/685,417, filed on Jan. 11, 2010, now abandoned, and a continuation-in-part of application No. 12/689,158, filed on Jan. 18, 2010, and a continuation-in-part of application No. 12/702,762, filed on Feb. 9, 2010, now Pat. No. 8,355,951, and a continuation-in-part of application No. 12/704,332, filed on Feb. 11, 2010.

(60) Provisional application No. 61/305,415, filed on Feb. 17, 2010.

(51) Int. Cl.
*G08B 23/00* (2006.01)

(52) U.S. Cl.
CPC ..... *G08B 23/00* (2013.01)

(58) Field of Classification Search
CPC ..... G08B 13/08; G08B 21/22; G06F 21/32; G07C 9/00111; G07C 9/00158; G07C 9/00087; G06K 9/00885; G06K 2009/00932
USPC ..... 340/540–567, 573.1, 5.8, 5.81–5.85; 382/115; 713/185
See application file for complete search history.

(56) References Cited

U.S. PATENT DOCUMENTS

| | | | | |
|---|---|---|---|---|
| 5,793,409 | A | 8/1998 | Tetsumura | |
| 6,950,534 | B2 | 9/2005 | Cohen et al. | |
| 7,134,130 | B1 | 11/2006 | Thomas | |
| 8,078,290 | B2 | 12/2011 | Nelson | |
| 2003/0235335 | A1 | 12/2003 | Yukhin et al. | |
| 2004/0222047 | A1 | 11/2004 | Difranza | |
| 2006/0136962 | A1 | 6/2006 | Masaki | |
| 2006/0218057 | A1 | 9/2006 | Fitzpatrick et al. | |
| 2007/0001835 | A1* | 1/2007 | Ward et al. | 340/522 |
| 2007/0268145 | A1* | 11/2007 | Bazakos et al. | 340/573.1 |
| 2007/0285510 | A1 | 12/2007 | Lipton et al. | |
| 2008/0046930 | A1 | 2/2008 | Smith et al. | |
| 2008/0074256 | A1* | 3/2008 | Hirai et al. | 340/541 |
| 2008/0134102 | A1 | 6/2008 | Movold et al. | |
| 2008/0244639 | A1 | 10/2008 | Kaaz | |
| 2008/0313556 | A1* | 12/2008 | Zhang | G06F 21/36 715/765 |

(Continued)

OTHER PUBLICATIONS

Non-Final Office Action mailed Aug. 5, 2013, U.S. Appl. No. 13/302,968, filed Nov. 22, 2011, 19 pages.

(Continued)

*Primary Examiner* — Laura Nguyen
(74) *Attorney, Agent, or Firm* — Alberto Interian, III, Esq.

(57) ABSTRACT

A system comprising: at least one processor; at least one sensor; and computer executable instructions readable by the at least one processor and operative to: use the at least one sensor to determine a number of persons or identity of a person; and trigger an alarm based on the number of persons or the identity of the person. A method comprising: using at least one processor to perform any or all of the following: use at least one sensor to determine a number of persons or identity of a person; and triggering an alarm based on the number of persons or the identity of the person.

18 Claims, 7 Drawing Sheets

(56) References Cited

U.S. PATENT DOCUMENTS

| | | | | |
|---|---|---|---|---|
| 2009/0079813 | A1 | 3/2009 | Hildreth | |
| 2009/0092284 | A1 | 4/2009 | Breed et al. | |
| 2009/0097713 | A1* | 4/2009 | DeLean | 382/115 |
| 2009/0172808 | A1* | 7/2009 | Maruya et al. | 726/18 |
| 2010/0111370 | A1* | 5/2010 | Black et al. | 382/111 |
| 2010/0164680 | A1* | 7/2010 | Yancey et al. | 340/5.32 |
| 2010/0185341 | A1 | 7/2010 | Wilson et al. | |
| 2010/0265066 | A1 | 10/2010 | Edelman | |
| 2010/0279664 | A1* | 11/2010 | Chalk | 455/414.1 |
| 2011/0012729 | A1 | 1/2011 | Hess | |

OTHER PUBLICATIONS

PCT International Search Report, PCT/US2011/020869, 5 pages, mailed Jul. 18, 2011, European Patent Office, International Searching Authority.

* cited by examiner

SECURITY SYSTEM AND METHOD

PRIORITY CLAIM

This patent application is a continuation-in-part patent application and claims priority to U.S. Non-Provisional patent application Ser. No. 12/685,417, titled "System and Method for Broadcasting Media," filed Jan. 11, 2010; U.S. Non-Provisional patent application Ser. No. 12/689,158, titled "System and Method for Broadcasting Media," filed Jan. 18, 2010; U.S. Non-Provisional patent application Ser. No. 12/702,762, titled "System and Method for Broadcasting Media," filed Feb. 9, 2010; U.S. Non-Provisional patent application Ser. No. 12/704,332, titled "System and Method for Administering Remote Content," filed Feb. 11, 2010; U.S. Provisional Application Ser. No. 61/305,415, titled "Security System and Method," filed Feb. 17, 2010; and Patent Corporation Treaty Application Serial No.: PCT/US11/20869, titled "System and Method for Broadcasting Media," filed Jan. 11, 2011; all of which are hereby incorporated by reference as if fully stated herein.

FIELD

The present disclosure relates generally to electronic systems, and more particularly, to electronic systems, methods, and various other disclosures related to security.

BACKGROUND

Traditionally, security systems, such as home and office security systems, have been based on detecting a break-in, such as whether a door or window has been broken. More sophisticated security systems have been based on motion detection and sound detection as well. Despite the existence of such security systems, break-ins, such as burglaries, still occur frequently.

Furthermore, most security systems, particularly home security systems, do not allow any persons to be present in the monitored premises while the security system is activated.

SUMMARY

The various embodiments of systems and methods disclosed herein result from the realization that break-ins, such as burglaries, can be prevented by providing a system and method for determining a number and/or identity of persons, such as persons in a space, and triggering an alarm based on the number and/or identity of the persons. The various embodiments of systems and methods disclosed herein result from the further realization that by triggering an alarm based on the identity or number of persons in space, certain authorized persons may be allowed to remain in the monitored space while the security system is activated.

DETAILED DESCRIPTION OF PREFERRED EMBODIMENTS

System Level Overview

Figure 1A:
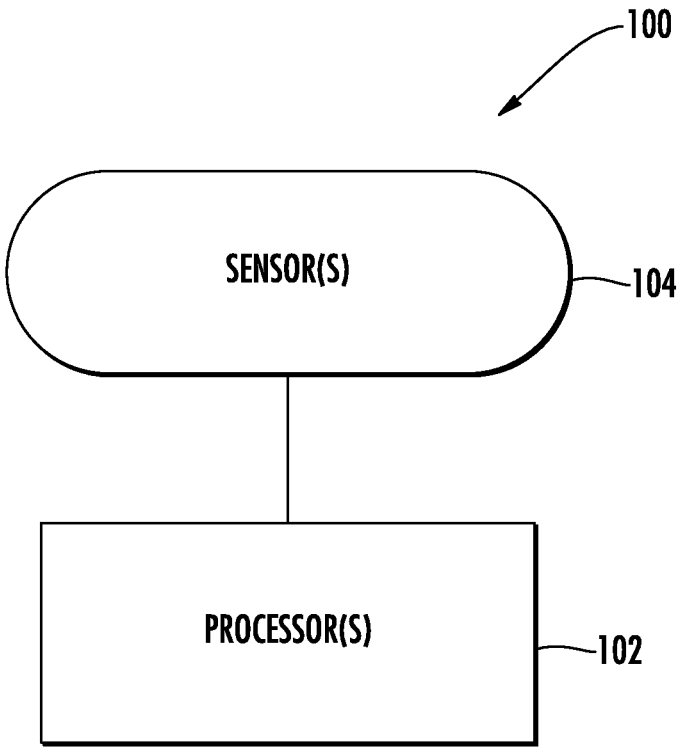
FIGS. 1A through 1E show a system in accordance with various embodiments.
Figure 1B:
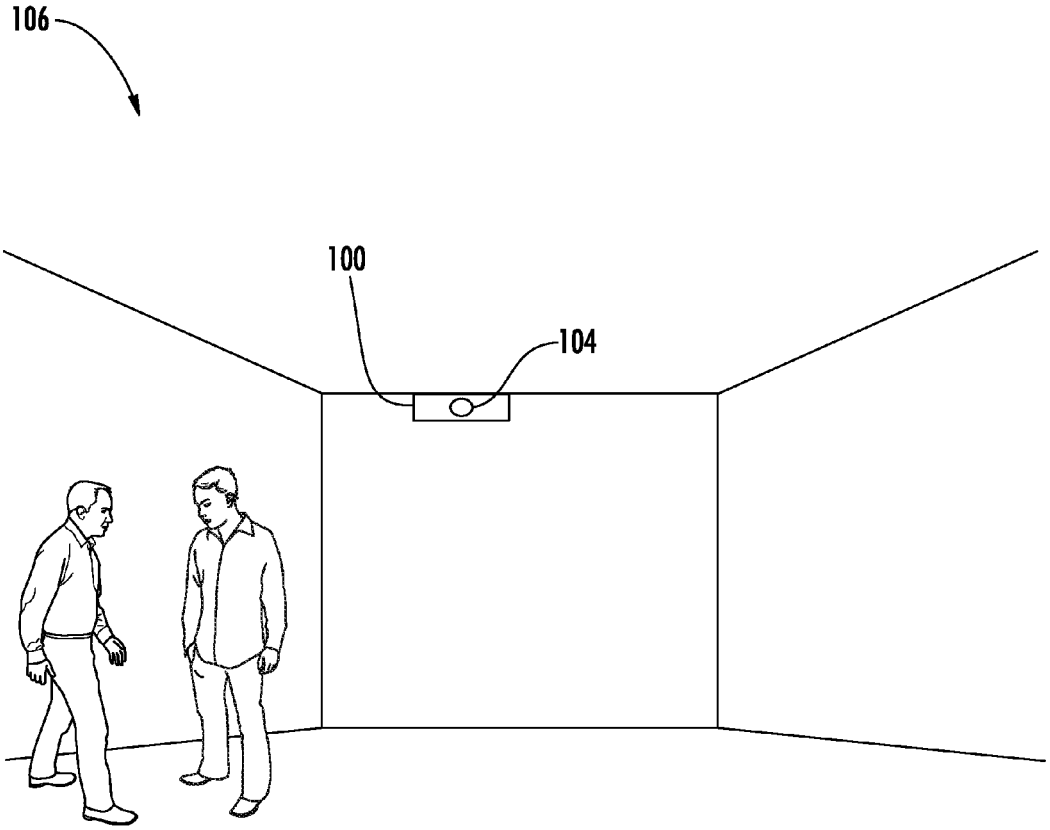

FIGS. 1A and 1B show a system 100 in accordance with some embodiments. In one embodiment, system 100 comprises at least one processor 102, at least one sensor 104, wherein the at least one sensor 104 may be electronically connected to the at least one processor 102, and computer executable instructions (not shown) readable by the at least one processor 102 and operative to use the at least one sensor 104 to determine a number of persons or identity of a person, and trigger an alarm based on the number of persons or the identity of the person. The persons or the person may be in a space 106, such as, but not limited to, a room, a porch, and the like.

The terms "electronically connected," "electronic connection," and the like, as used throughout the present disclosure, are intended to describe any kind of electronic connection or electronic communication, such as, but not limited to, a physically connected or wired electronic connection and/or a wireless electronic connection.

In some embodiments, the at least one processor 102 may be any kind of processor, including, but not limited to, a single core processor, a multi core processor, a video processor, and the like.

At least one sensor 104 may be any kind of sensor, such as, but not limited to, a camera, an infrared camera, a thermal imaging camera, a video sensor, a digital camera, a 3D sensor or camera, a microphone, a room occupancy sensor, a tactile sensor, such as a vibration sensor, a chemical sensor, such as an odor sensor, an electrical sensor, such as a capacitive sensor, a resistive sensor, and a thermal sensor, such as a heat sensor and/or infrared camera, and the like. In some embodiments, the 3D sensor or camera may be any type of 3D sensor or camera, such as a time of flight sensor or structured light sensor, which may include any of those various embodiments developed or produced by Optrima NV, Witherenstraat 4-1040 Brussels, Belgium; Prime Sense, 28 Habarzel St., $4^{th}$ Floor, Tel-Aviv, 69710, Israel; PMDTechnologies GmbH, Am Eichenlag 50, D-57076 Siegen, Germany; and Microsoft, Corp., One Microsoft Way, Redmond, Wash., USA.

The computer executable instructions may be loaded directly on the processor, or may be stored in a storage means, such as, but not limited to, computer readable media, such as, but not limited to, a hard drive, a solid state drive, a flash memory, random access memory, CD-ROM, CD-R, CD-RW, DVD-ROM, DVD-R, DVD-RW, and the like. The computer executable instructions may be any type of computer executable instructions, which may be in the form of a computer program, the program being composed in any suitable programming language or source code, such as C++, C, JAVA, JavaScript, HTML, XML, and other programming languages.

In one embodiment, the computer executable instructions may include object recognition software and/or firmware, which may be used to determine the number of persons. Such object recognition software may include image recognition software, which may, in turn, include facial recognition software, or may simply include general visual object recognition software. In another embodiment, the object recognition software may be audio based, being able to distinguish objects (e.g. persons) that are producing certain audio (such as breathing, talking, etc.). In yet a further embodiment, the object recognition software may use a plurality of at least one sensors to determine how many persons or the identity of a person.

In some embodiments, using at least one 3D sensor to determine a number of persons or identity of a person comprises using computer executable instructions to analyze the data captured by at least one 3D sensor, and to determine the number of persons or identity of a person in the 3D sensor's field of sensing. The terms "object recognition software," "facial recognition software," and "image recognition software," as used throughout the present disclosure, may refer to the various embodiments of object recognition software known in the art, including, but not limited to, those embodiments described in the following publications: *Reliable Face Recognition Methods: System Design, Implementation, and Evaluation*, by Harry Wechsler, Copyright 2007, Published by Springer, ISBN-13: 978-0-387-22372-8; *Biometric Technologies and Verification Systems*, by John Vacca, Copyright 2007, Elsevier, Inc., Published by Butterworth-Heinemann, ISBN-13: 978-0-7506-7967-1; and *Image Analysis and Recognition*, edited by Aurelio Campilho and Mohamed Kamel, Copyright 2008, Published by Springer, ISBN-13: 978-3-540-69811-1, *Eye Tracking Methodology: Theory and Practice*, by Andrew T. Duchowski, Copyright 2007, Published by Springer, ISBN 978-1-84628-608-7, all of which are herein incorporated by reference. In one embodiment, the object recognition software may comprise 3D sensor middleware, which may include 3D gesture control and/or object recognition middle ware, such as those various embodiments produced and developed by Softkinetic S. A., 24 Avenue L. Mommaerts, Brussels, B-1140, Belgium, Microsoft Corp., One Microsoft Way, Redmond, Wash., USA, and Omek Interactive, 2 Hahar Street, Industrial Zone Har Tuv A, Ganir Center Beith Shemesh 99067, Israel.

In some embodiments, the computer executable instructions may be further operative to compare the number or identity of persons that are determined with a number or identity of persons that are authorized, such as being authorized to be in a space 106. In some embodiments, the number or identity of persons that are authorized may be contained in a database. In other embodiments, the number or identity of persons that are authorized may be received from a remote station, such as a security monitoring station, in communication with system 100. In yet other embodiments, the number of persons that are authorized may be contained on a piece of media hardware, such as a DVD, CD, and the like.

In a further embodiments, system 100 comprises at least one means for communication with a local device, wherein the means for communicating with the local device may be electronically connected to the at least one processor 102. In some embodiments, such means may include a Bluetooth module, a USB port, an infrared port, a network adapter, such as a Wi-Fi card, and the like. The local device may be any kind of device, such as a television, a computer, a remote control, a telephone, a portable digital assistant, and the like.

In a further embodiment, the computer executable instructions may be operative to trigger an alarm if the number or identity of persons determined exceeds or does not match the number or identity of persons authorized. In some embodiments, the alarm may be a local alarm, such as an audible alarm capable of being perceived by the persons being sensed. In yet another embodiment, the alarm may be a remote alarm, such as an alert sent by system 100 to a remote user, wherein the alert may be any kind of alert, including, but not limited to, an e-mail, and SMS message, a phone call, and the like.

In yet another embodiment, system 100 further comprises at least one means for communicating with a remote station, wherein the means for communicating may be electronically connected to the at least one processor 102. In some embodiments, the means for communicating with a remote station may be any kind of means, such as, but not limited to, a wireless modem, such as a GSM modem, a wired modem, an Ethernet adapter, a Wi-Fi adapter, and the like. In some embodiments, the remote station may be a security service provider, or a remote communications device, such as, but not limited to, a cellular phone, a phone, a computer, and the like. In such embodiments, the computer executable instructions may be further operative to use the at least one means for communicating with a remote station to transmit or receive information to or from the remote station. The information may include the number or identity of authorized persons, billing information, and software updates. In some embodiments, a user, such as a person, may use system 100 to select and/or download the content, or select the number or identity of authorized persons.

Figure 1C:
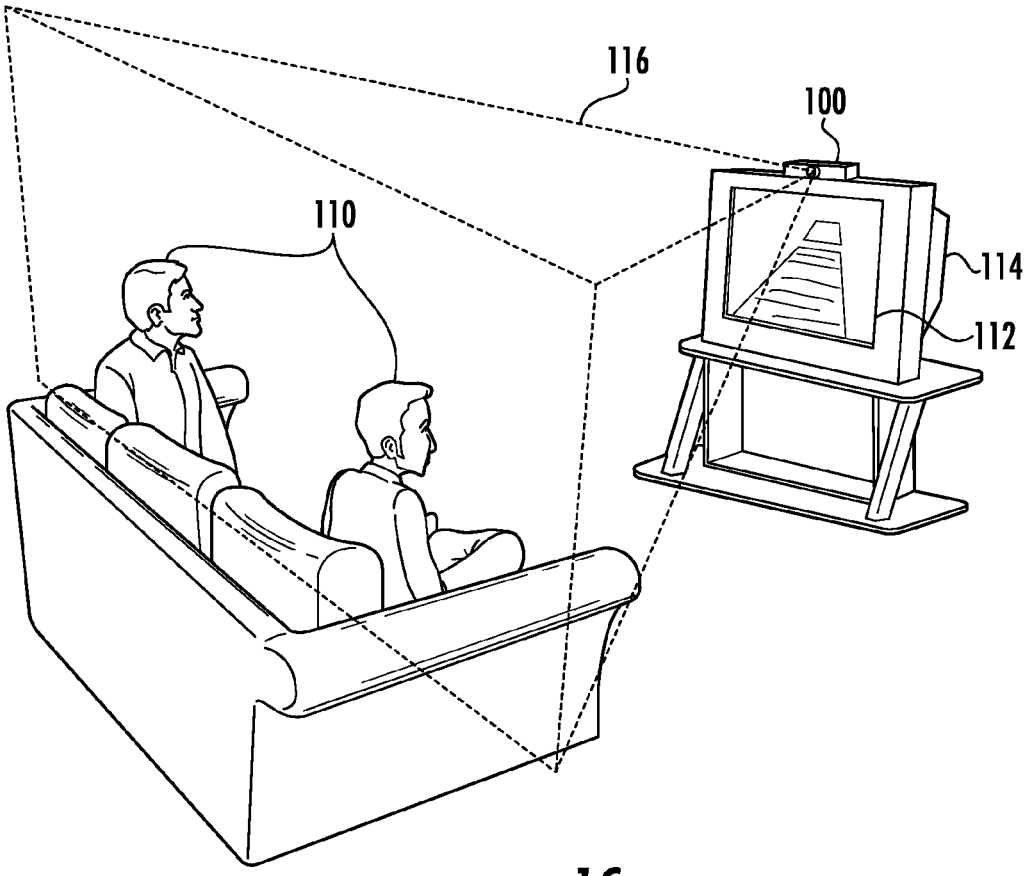
Figure 1D:
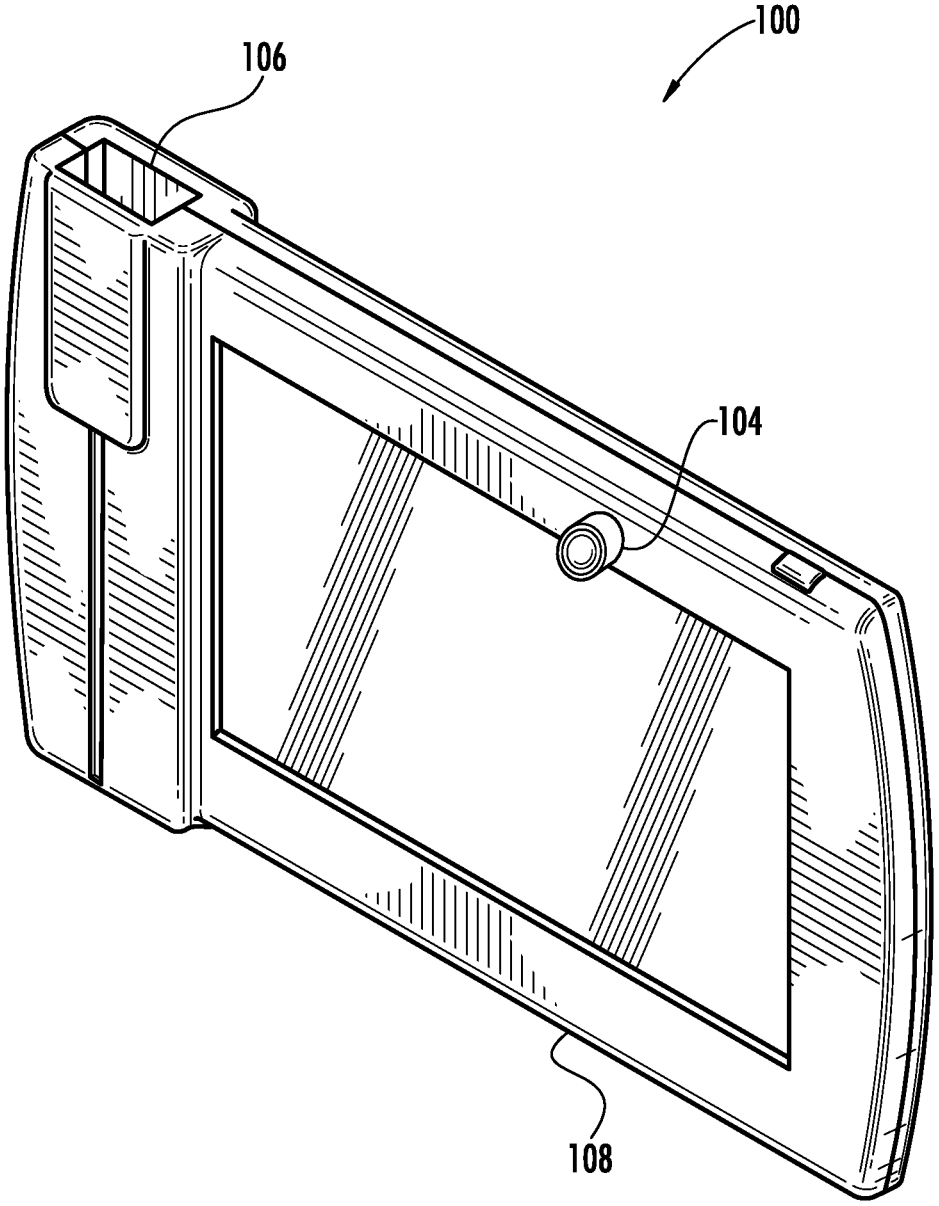
Figure 1E:
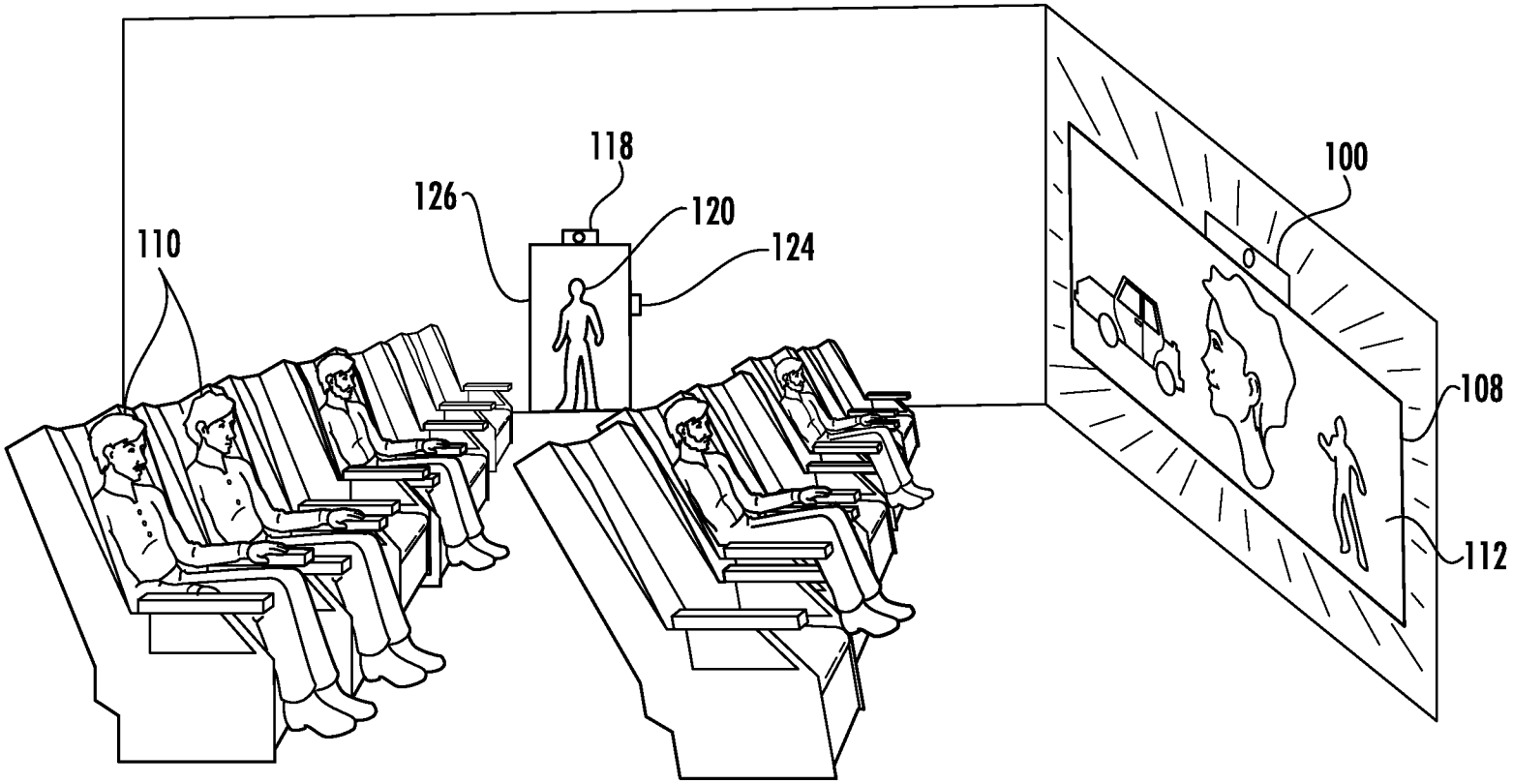

In one embodiment, system 100 may be positioned on or near a display device 114, such as a television or computer monitor (as shown in FIG. 1C). In other embodiments, system 100 may be positioned within, or integrated with a display device 114, such as a television, tablet computer (as shown in FIG. 1D), personal computer, laptop computer, and the like. In another embodiment, system 100 may be part of or positioned within a theatre, such as, but not limited to, a movie theatre (as shown in FIG. 1E), a home theatre, a hotel theatre, a mini theatre In some embodiments, system 100 may further comprise a means for receiving input, which in some embodiments, may be any type of means, including, but not limited to: a telephone modem: a key pad, a key board, a remote control, a touch screen, a virtual keyboard, a mouse, a stylus, a microphone, a camera, a fingerprint scanner, and a retinal scanner. In a further embodiment, system 100 may include a biometric identification means 112 to identify a person, such as a fingerprint scanner, an eye scanner, and facial recognition software.

In another embodiment, the computer executable instructions may be operative to allow for the number or identity of authorized persons to be changed or added to. In one embodiment, if the number of persons or the identity of persons determined does not correspond to the number or identity of persons authorized to perceive the content, the computer executable instructions may be operative to allow a person to increase the number of persons authorized to perceive the content, or to add a person's identity to the identities authorized to perceive the content. Such an operation may be accomplished by bringing up an electronic menu on a display device, such as a personal computer, a personal communications device, such as a cellular phone, and the like, that prompts a person to increase the number of persons, or to add an identity of a person to the identities authorized. Alternatively, the computer executable instructions may be operative to allow a person to decrease the number of persons authorized, or to remove a person's identity from the identities authorized.

In one embodiment, system 100 may be positioned on, in, or near a space 106, such as a room, such as a room in a home, office, store, and the like. System 100 may be used to monitor the number of persons or the identity of a person in that space 106, and trigger an alarm if an unauthorized number or identity of persons is detected.

In a further embodiment, system 100 may comprise at least one means for identifying a person entering or leaving a space 106 that is being monitored. At least one means for identifying a person, may include any kind of means for identifying a person, such as a biometric identifications means, such as, but not limited to, an eye scanner, a face scanner, a finger print scanner, a key reader, a card reader, a smart card reader, and the like. In some embodiments, at least one means for identifying a person may be used to determine the identity of persons attempting to enter or in the space 106. At least one means for identifying a person may be electronically connected to and/or in electronic communication with at least one processor 102, and/or at least one sensor 104.

In yet a further embodiment, system 100 may comprise at least one means for restricting access to a space 106 that is being monitored, wherein the restriction may be based on the number of persons or the identity of a person in or attempting to enter or leave the space 106 being monitored. The means for restricting access may be any kind of means for restricting access, such as a door, a lock, a turn style, a limited access elevator, a security guard, and the like. In some embodiments, at least one means for restricting access to space 106 may be electronically connected to and/or in electronic communication with at least one processor 102, and/or at least one sensor 104.

In yet a further embodiment, if by any means, such as by using at least one sensor 104 and/or an occupancy sensor, the number or identity of persons attempting to enter space 106, or the number of persons that are in the space 106 is determined to exceed or not correspond to the number or identity of persons authorized, the at least one means for restricting access to the space 106 may be used to prevent further entry into the space 106. Likewise, if by any means, such as those described above, the number and/or identity of persons attempting to enter space 106 is determined to be within authorized limits, the at least one means for restricting access to the space 106 may be used to allow entry into the space 106.

Throughout the present disclosure, it should be understood that computer executable instructions, such as those in system 100, may be used to manipulate and use the various embodiments of systems and components thereof, such as the at least one processor, at least one sensor 104, the at least one occupancy sensor, the at least one means for identifying a person, and/or the at least one means for restricting access.

Method Embodiments

Figure 2:
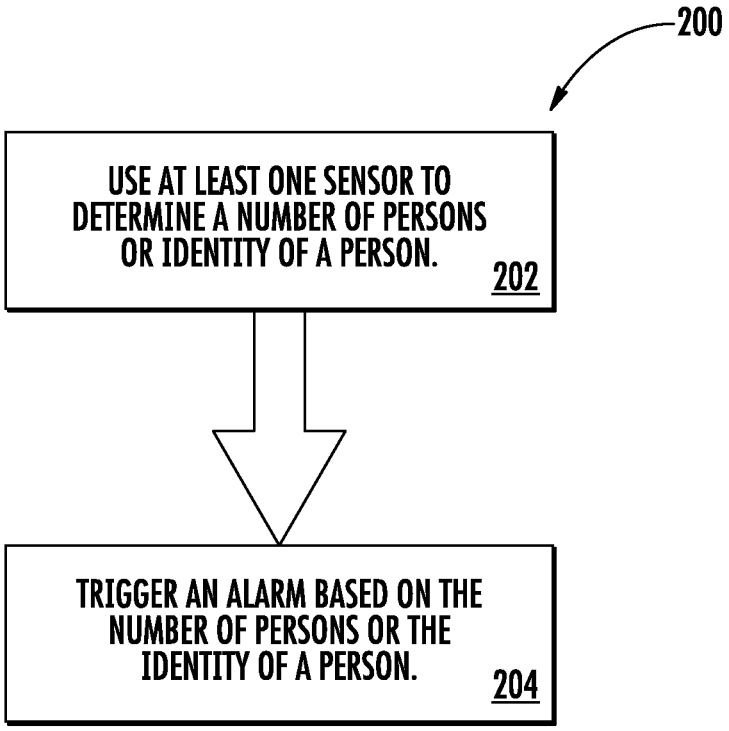
FIG. 2 shows a block diagram depicting a method, in accordance with one embodiment.

Referring now to FIG. 2, a method 200 is shown, wherein method 200 comprises using at least one processor to perform any or all of the following: use at least one sensor to determine a number of persons or identity of a person (block 202); and triggering an alarm based on the number of persons or the identity of the person (block 204). The persons or the person may be in a space 106, such as, but not limited to, a room, a porch, and the like.

In some embodiments, the at least one processor may be any kind of processor, including, but not limited to, a single core processor, a multi core processor, a video processor, and the like.

In some embodiments of method 200, using at least one sensor to determine a number of persons or identity of a person comprises using at least one 3D sensor to determine a number of persons or identity of a person. In other embodiments, the at least one sensor may be any kind of sensor, such as, but not limited to, a camera, an infrared camera, a thermal imaging camera, a video sensor, a digital camera, a 3D sensor or camera, a microphone, a room occupancy sensor, a tactile sensor, such as a vibration sensor, a chemical sensor, such as an odor sensor, an electrical sensor, such as a capacitive sensor, a resistive sensor, and a thermal sensor, such as a heat sensor and/or infrared camera, and the like. In some embodiments, the 3D sensor or camera may be any type of 3D sensor or camera, such as a time of flight sensor or structured light sensor, which may include any of those various embodiments developed or produced by Optrima NV, Witherenstraat 4-1040 Brussels, Belgium; Prime Sense, 28 Habarzel St., 4$^{th}$ Floor, Tel-Aviv, 69710, Israel; PMDTechnologies GmbH, Am Eichenlag 50, D-57076 Siegen, Germany; and Microsoft, Corp., One Microsoft Way, Redmond, Wash., USA.

In some embodiments using at least one 3D sensor to determine a number of persons or identity of a person comprises using computer executable instructions to analyze the data captured by at least one 3D sensor, and to determine the number of persons or identity of a person in the 3D sensor's field of sensing. In some embodiments, the computer executable instructions may be loaded directly on the processor, or may be stored in a storage means, such as, but not limited to, computer readable media, such as, but not limited to, a hard drive, a solid state drive, a flash memory, random access memory, CD-ROM, CD-R, CD-RW, DVD-ROM, DVD-R, DVD-RW, and the like. The computer executable instructions may be any type of computer executable instructions, which may be in the form of a computer program, the program being composed in any suitable programming language or source code, such as C++, C, JAVA, JavaScript, HTML, XML, and other programming languages.

In one embodiment, the computer executable instructions may include object recognition software and/or firmware, which may be used to determine the number of persons. Such object recognition software may include image recognition software, which may, in turn, include facial recognition software, or may simply include general visual object recognition software. In another embodiment, the object recognition software may be audio based, being able to distinguish objects (e.g. persons) that are producing certain audio (such as breathing, talking, etc.). In yet a further embodiment, the object recognition software may use a plurality of at least one sensors to determine how many persons or the identity of a person.

The terms "object recognition software," "facial recognition software," and "image recognition software," may refer to the various embodiments of object recognition software known in the art, including, but not limited to, those embodiments described in the following publications: *Reliable Face Recognition Methods: System Design, Implementation, and Evaluation*, by Harry Wechsler, Copyright 2007, Published by Springer, ISBN-13: 978-0-387-22372-8; *Biometric Technologies and Verification Systems*, by John Vacca, Copyright 2007, Elsevier, Inc., Published by Butterworth-Heinemann, ISBN-13: 978-0-7506-7967-1; and *Image Analysis and Recognition*, edited by Aurelio Campilho and Mohamed Kamel, Copyright 2008, Published by Springer, ISBN-13: 978-3-540-69811-1, *Eye Tracking Methodology: Theory and Practice*, by Andrew T. Duchowski, Copyright 2007, Published by Springer, ISBN 978-1-84628-608-7, all of which are herein incorporated by reference. In one embodiment, the object recognition software may comprise 3D sensor middleware, which may include 3D gesture control and/or object recognition middle ware, such as those various embodiments produced and developed by Softkinetic S. A., 24 Avenue L. Mommaerts, Brussels, B-1140, Belgium, Microsoft Corp., One Microsoft Way, Redmond, Wash., USA, and Omek Interactive, 2 Hahar Street, Industrial Zone Har Tuv A, Ganir Center Beith Shemesh 99067, Israel.

In some embodiments, method 200 may further comprise using at least one processor to compare the number or identity of persons that are determined with a number or identity of persons that are authorized, such as being authorized to be in a space. In some embodiments, the number or identity of persons that are authorized may be contained in a database. In other embodiments, the number or identity of persons that are authorized may be received from a remote station, such as a security monitoring station, in communication with the at least one processor. In yet other embodiments, the number of persons that are authorized may be contained on a piece of media hardware, such as a DVD, CD, and the like.

In a further embodiments, method 200 comprises using at least one means for communication to communicate with a local device, wherein the means for communicating may be electronically connected to the at least one processor. In some embodiments, such means may include a Bluetooth module, a USB port, an infrared port, a network adapter, such as a Wi-Fi card, and the like. The local device may be any kind of device, such as a television, a computer, a remote control, a telephone, a portable digital assistant, and the like.

In a further embodiment, triggering an alarm may comprise triggering an alarm if the number or identity of persons determined exceeds or does not match the number or identity of persons authorized. In some embodiments, the alarm may be a local alarm, such as an audible alarm capable of being perceived by the persons being sensed. In yet another embodiment, the alarm may be a remote alarm, such as an alert sent to a remote user, wherein the alert may be any kind of alert, including, but not limited to, an e-mail, and SMS message, a phone call, and the like.

In yet another embodiment, method 200 further comprises using at least one means for communicating to communicate with a remote station, wherein the means for communicating may be electronically connected to the at least one processor. In some embodiments, the means for communicating may be any kind of means, such as, but not limited to, a wireless modem, such as a GSM modem, a wired modem, an Ethernet adapter, a Wi-Fi adapter, and the like. In some embodiments, the remote station may be a security service provider, or a remote communications device, such as, but not limited to, a cellular phone, a phone, a computer, and the like. In such embodiments, method 200 may further comprise using the at least one means for communicating to transmit or receive information to or from the remote station. The information may include the number or identity of authorized persons, billing information, and software updates. In some embodiments, method 200 comprises allowing at least one user, such as a person, to select and/or download the content, or select the number or identity of authorized persons.

In some embodiments, method 200 may further comprise using at least one means for receiving input to receive user input, which in some embodiments, may be any type of means, including, but not limited to: a telephone modem: a key pad, a key board, a remote control, a touch screen, a virtual keyboard, a mouse, a stylus, a microphone, a camera, a fingerprint scanner, and a retinal scanner. In a further embodiment, method 200 may comprise using a biometric identification means to identify a person, wherein such means may comprise any biometric identification means, such as a fingerprint scanner, an eye scanner, and facial recognition software.

In one embodiment, method 200 may comprise allowing for the number or identity of authorized persons to be changed or added to. In one embodiment, method 200 may comprise allowing a person to increase the number of persons or change the identity of a person authorized to be present in a space if the number of persons or the identity of persons determined does not correspond to the number or identity of persons authorized to be in a space. Such an operation may be accomplished by bringing up an electronic menu on a display device, such as a personal computer, a personal communications device, such as a cellular phone, and the like, that prompts a person to increase the number of persons, or to add or change an identity of a person to the identities or numbers authorized. Alternatively, method 200 may comprise allowing a person to decrease the number of persons authorized, or to remove a person's identity from the identities authorized.

In a further embodiment, method 200 may comprise using at least one means for identifying a person to identify a person entering or leaving a space that is being monitored. At least one means for identifying a person, may include any kind of means for identifying a person, such as a biometric identifications means, such as, but not limited to, a 3D sensor, an eye scanner, a face scanner, a finger print scanner, a key reader, a card reader, a smart card reader, and the like. In some embodiments, at least one means for identifying a person may be used to determine the identity of persons attempting to enter or in the space. At least one means for identifying a person may be electronically connected to and/or in electronic communication with the at least one processor, and/or the at least one sensor.

In yet a further embodiment, method 200 may comprise using at least one means for restricting access to a space to restrict access to a space that is being monitored. In some embodiments, restricting access to a space may be based on the number of persons or the identity of a person in or attempting to enter or leave the space being monitored, and may comprise refusing access to the space if the identity or number of persons attempting to enter or leave the space is not authorized, or allowing access if the identity or number of persons attempting to enter or leave the space is authorized. The means for restricting access may be any kind of means for restricting access, such as a door, a lock, a turn style, a limited access elevator, a security guard, and the like. In some embodiments, at least one means for restricting access to the space may be electronically connected to and/or in electronic communication with the at least one processor, and/or the at least one sensor.

In yet a further embodiment, if by any means, such as by using at least one sensor and/or an occupancy sensor, the number or identity of persons attempting to enter a space, or the number of persons that are in a space is determined to exceed or not correspond to the number or identity of persons authorized, the at least one means for restricting access to the space may be used to prevent further entry into the space. Likewise, if by any means, such as those described above, the number and/or identity of persons attempting to enter the space is determined to be within authorized limits, the at least one means for restricting access to the space may be used to allow entry into the space.

Throughout the present disclosure, it should be understood that computer executable instructions, such as those described with reference to system 100 and method 200, may be used to manipulate and use the various embodiments of systems and components thereof, such as the at least one processor, at least one sensor, the at least one occupancy sensor, the at least one means for identifying a person, and/or the at least one means for restricting access.

Hardware and Operating Environment

This section provides an overview of example hardware and the operating environments in conjunction with which embodiments of the inventive subject matter may be implemented.

A software program may be launched from a computer readable medium in a computer-based system to execute function defined in the software program. Various programming languages may be employed to create software programs designed to implement and perform the methods disclosed herein. The programs may be structured in an object-orientated format using an object-oriented language such as Java or C++. Alternatively the programs may be structured in a procedure-oriented format using a procedural language, such as assembly or C. The software components may communicate using a number of mechanisms, such as application program interfaces, or inter-process communication techniques, including remote procedure calls. The teachings of various embodiments are not limited to any particular programming language or environment. Thus, other embodiments may be realized, as discussed regarding FIG. 3 below.

Figure 3:
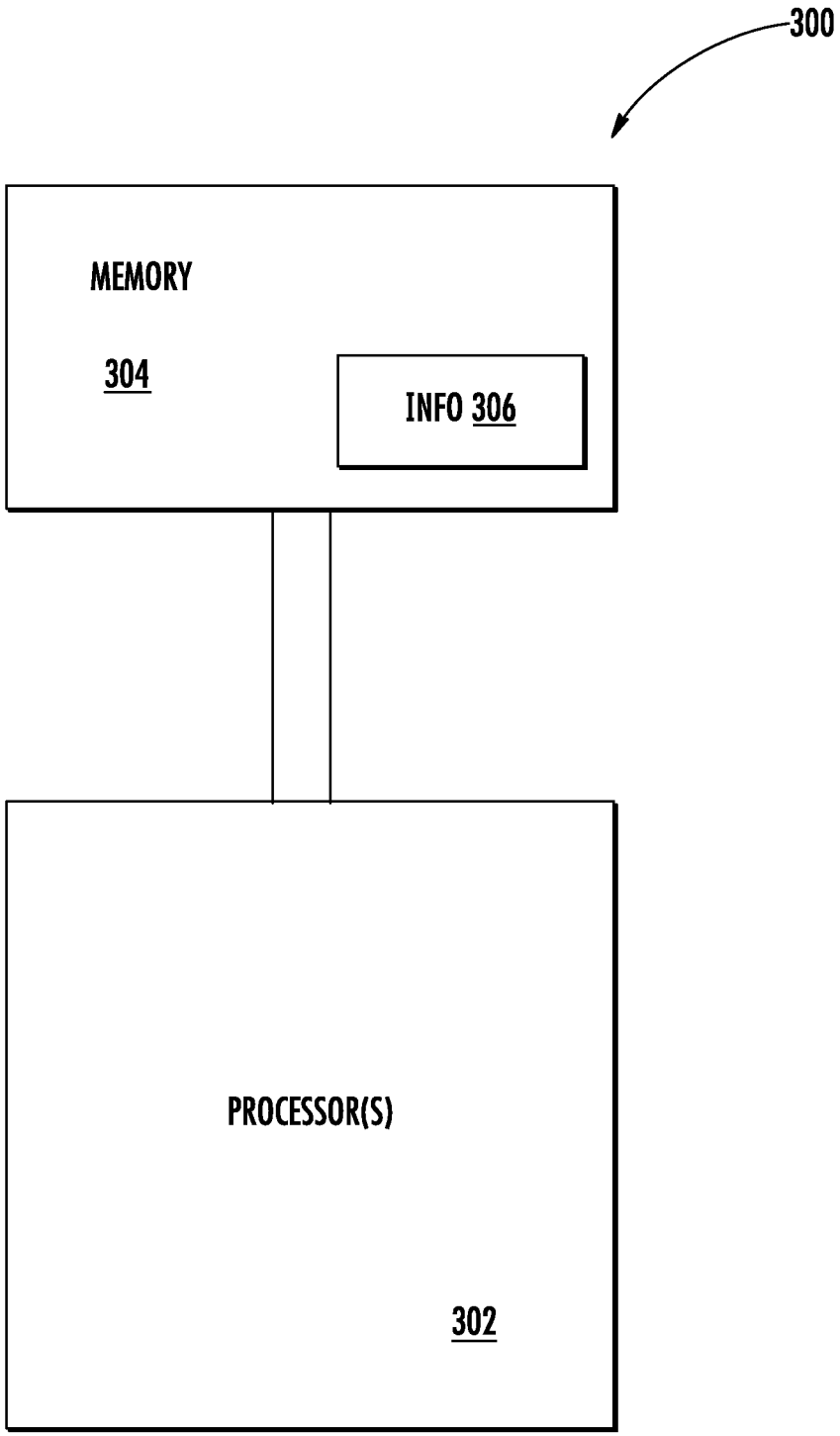
FIG. 3 shows an article in accordance with one embodiment.

FIG. 3 is a block diagram representing an article according to various embodiments. Such embodiments may comprise a computer, a memory system, a magnetic or optical disk, some other storage device, or any type of electronic device or system. The article 300 may include one or more processor(s) 302 coupled to a machine-accessible medium such as a memory 304 (e.g., a memory including electrical, optical, or electromagnetic elements). The medium may contain associated information 306 (e.g., computer program instructions, data, or both) which, when accessed, results in a machine (e.g., the processor(s) 302) performing the activities previously described herein.

The principles of the present disclosure may be applied to all types of computers, systems, and the like, include desktop computers, servers, notebook computers, personal digital assistants, and the like. However, the present disclosure may not be limited to the personal computer.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A system comprising:

at least one processor;

at least one 3D camera, in communication with the at least one processor; and computer executable instructions readable by the at least one processor and operative to:

use the at least one 3D camera to visually observe a number of persons in a space, relying on object recognition computer executable instructions to determine a number and/or identity of persons in the space, wherein the object recognition computer executable instructions performs: image detection in the space, thermal detection in the space, detection of audio of persons in the space, counting the number of persons in the space, and analysis of data captured by the at least one 3D camera;

compare the number of persons that are determined to be in the space with a number of persons authorized to be in the space, wherein the comparison depends on the number of authorized persons that should be in the space as specified by a number stored in a database, wherein the number of persons authorized to be in the space is selected by a user of the system;

trigger an alarm if the number of persons determined to be in the space exceeds or does not correspond to the number of persons authorized to be in the space; and allow the number of persons authorized to be in the space to be changed if the number of persons in the space does not match or exceeds the number of persons authorized to be in the space.

2. The system of claim 1, wherein the computer executable instructions are operative to receive the number of persons authorized to be in the space from a remote station.

3. The system of claim 1, wherein the 3D camera comprises a time of flight sensor.

4. The system of claim 1, wherein the 3D camera comprises a structured light sensor.

5. The system of claim 1, further comprising a device for identifying a person entering or leaving the space, wherein the device is any one of: an eye scanner, a face scanner, a finger print scanner, a key reader, a card reader, a smart card reader and wherein the computer executable instructions may be operative to use the device for identifying a person entering or leaving the space to determine the identity of persons in the space, or attempting to enter or leave the space.

6. The system of claim 1, further comprising a device for restricting access to the space wherein the device is any one of: a door, lock, turnstile, or limited access elevator, wherein the computer executable instructions may be operative to use the device for restricting access to the space to prevent access to the space if the number of persons in the space, or attempting to enter or leave the space exceeds or does not correspond to the number of persons authorized to be in the space.

7. The system of claim 1, further comprising a device for restricting access to the space wherein the device is any one of: a door, lock, turnstile, or limited access elevator, wherein the computer executable instructions may be operative to use the device for restricting access to the space to allow access to the space if the number of persons in the space, or attempting to enter or leave the space corresponds to or does not exceed the number of persons authorized to be in the space.

8. The system of claim 1, wherein the space comprises a theatre and further comprising a device for restricting access to the theatre wherein the device is any one of: a door, lock, turnstile, or limited access elevator, and wherein the computer executable instructions may be operative to use the device for restricting access to the theatre to restrict access to the theatre based on the number of persons in the theatre, or attempting to enter or leave the theatre.

9. The system of claim 1, wherein the at least one 3D camera is positioned in a theatre.

10. A method comprising:

using at least one processor to perform the following:

use at least one 3D camera to visually observe a number of persons in a space, relying on object recognition computer executable instructions to determine a number and/or identity of persons in the space, wherein the computer executable instructions performs: image detection in the space, thermal detection in the space, detection of audio of persons in the space, counting the number of persons in the space, and analysis of data captured by the at least one 3D camera;

compare the number of persons that are determined to be in the space with a number of persons authorized to be in the space, wherein the comparison depends on the number of authorized persons that should be in the space as specified by a number stored in a database, wherein the number of persons authorized to be in the space is selected by a user;

trigger an alarm if the number of persons determined to be in the space exceeds or does not correspond to the number of persons authorized to be in the space; and allow the number of persons authorized to be in the space to be changed if the number of persons in the space does not match or exceeds the number of persons authorized to be in the space.

11. The method of claim 10, further comprising using the at least one processor to receive the number of persons authorized to be in the space from a remote station.

12. The method of claim 10, wherein the 3D camera comprises a time of flight camera.

13. The method of claim 10, wherein the 3D camera comprises a structured light sensor.

14. The method of claim 10, further comprising the step of using a device for identifying a person entering or leaving the space to determine the identity of persons in the space, or attempting to enter or leave the space wherein the device is any one of: an eye scanner, a face scanner, a finger print scanner, a key reader, a card reader, a smart card reader.

15. The method of claim 10, further comprising the step of using a device for restricting access to the space, wherein the device is any one of: a door, lock, turnstile, or limited access elevator and wherein the device is used to prevent access to the space if the number of persons in the space, or attempting to enter or leave the space exceeds or does not correspond to the number of persons authorized to be in the space.

16. The method of claim 10, further comprising the step of using a device for restricting access to the space, wherein the device is any one of: a door, lock, turnstile, or limited access elevator and wherein the device is used to allow access to the space if the number of persons in the space, or attempting to enter or leave the space corresponds to or does not exceed the number of persons authorized to be in the space.

17. The method of claim 10, wherein the space comprises a theatre, and further comprising the step of using a device for restricting access to the theatre, wherein the device is any one of: a door, lock, turnstile, or limited access elevator, and wherein the device is used to restrict access to the theatre based on the number of persons in the theatre, or attempting to enter or leave the theatre.

18. The method of claim 10, wherein the at least one 3D camera is positioned in a theatre.

* * * * *